US006246022B1

(12) United States Patent
Faber et al.

(10) Patent No.: US 6,246,022 B1
(45) Date of Patent: Jun. 12, 2001

(54) CONTACTOR ARRANGEMENT INCLUDING INDIVIDUAL CONTACTOR HOUSINGS CONNECTED BY A RESILIENT ELONGATED CONNECTOR

(75) Inventors: Stephan Faber, Kümmersbruck; Klaus-Dieter Paul, Sulzbach-Rosenberg, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/380,035

(22) PCT Filed: Feb. 13, 1998

(86) PCT No.: PCT/DE98/00417

§ 371 Date: Aug. 25, 1999

§ 102(e) Date: Aug. 25, 1999

(87) PCT Pub. No.: WO98/38665

PCT Pub. Date: Sep. 3, 1998

(30) Foreign Application Priority Data

Feb. 27, 1997 (DE) ..... 297 03 565 U

(51) Int. Cl.[7] ..... H01H 9/02; H01H 9/08

(52) U.S. Cl. ..... 200/307; 312/111; 439/717

(58) Field of Search ..... 439/715, 717, 439/680, 701; 200/293–307; 335/161, 202; 248/27.1; 312/111, 322.3

(56) References Cited

U.S. PATENT DOCUMENTS

| | | | | |
|---|---|---|---|---|
| 3,970,812 | * | 7/1976 | Nowack | 200/307 |
| 4,591,228 | * | 5/1986 | Vasseur | 439/715 |
| 4,611,879 | * | 9/1986 | Bullard | 439/717 |
| 4,954,798 | * | 9/1990 | Kasahara et al. | 335/161 |
| 6,005,202 | * | 12/1999 | Drexler et al. | 200/50.33 |

FOREIGN PATENT DOCUMENTS

| | | |
|---|---|---|
| 10 25 493 | 3/1958 | (DE) . |
| 81 02 307 | 8/1982 | (DE) . |
| 38 28 277 | 3/1989 | (DE) . |
| 41 42 179 | 6/1993 | (DE) . |
| 44 13 385 | 10/1995 | (DE) . |
| 195 47 011 | 1/1997 | (DE) . |
| 0 626 712 | 11/1994 | (EP) . |
| 1 590 869 | 7/1970 | (FR) . |
| 2 550 907 | 2/1985 | (FR) . |

* cited by examiner

*Primary Examiner*—J. R. Scott
(74) *Attorney, Agent, or Firm*—Kenyon & Kenyon

(57) ABSTRACT

A connecting element is provided which has integrated catches in the area of the engagement sections, so that after they are inserted into engagement grooves have a matching shape on the individual contactors, the catches are engaged on a housing contour. Due to this design, when the individual contactor is screwed onto a base plate, dislocation of the connecting elements and migration to the base plate is prevented.

1 Claim, 2 Drawing Sheets

CONTACTOR ARRANGEMENT INCLUDING INDIVIDUAL CONTACTOR HOUSINGS CONNECTED BY A RESILIENT ELONGATED CONNECTOR

FIELD OF THE INVENTION

The present invention relates to a connecting element for joining individual contactors to form a contactor combination.

BACKGROUND OF THE INVENTION

Connecting elements for contactor combinations have been part of the delivery program of contactor manufacturers for a long time. With the contactors used for this purpose, the magnet chambers are provided with grooves, e.g., dovetail grooves or T-grooves. The conventional connecting elements are positioned in the area of top-hat rail mounts of the contactor. In this way, the connecting elements are secured against falling out. When the devices are screwed onto a base plate, it is possible for the connecting elements to become dislocated and migrate as far as the base plate.

Due to the increasing miniaturization of contactors, in particular the reduction in overall width, the possible positioning of the coupling site is limited by the available space in the magnet chamber. If the coupling site is outside the engagement area of the top-hat rail, dislocation of the connecting element must be reliably prevented.

SUMMARY

An object of the present invention is to create a connecting element with which dislocation is reliably prevented, regardless of the position of the contactors in the magnet chamber and regardless of the type of fastening, e.g., top-hat rail mount or screwing onto a base plate. This object is achieved by a connecting element having the following features:

a) The connecting element has engagement sections for insertion into suitably shaped engagement grooves in the contactors.

b) The connecting element of the engagement sections is provided with catches serving to engage on the individual contactors after insertion of the engagement sections into the engagement grooves.

c) The catches are molded onto resilient outside surfaces of the connecting element.

BRIEF DESCRIPTION OF THE DRAWINGS

One embodiment of the present invention is explained in greater detail below on the basis of a drawing, which shows.

DETAILED DESCRIPTION

Figure 1:
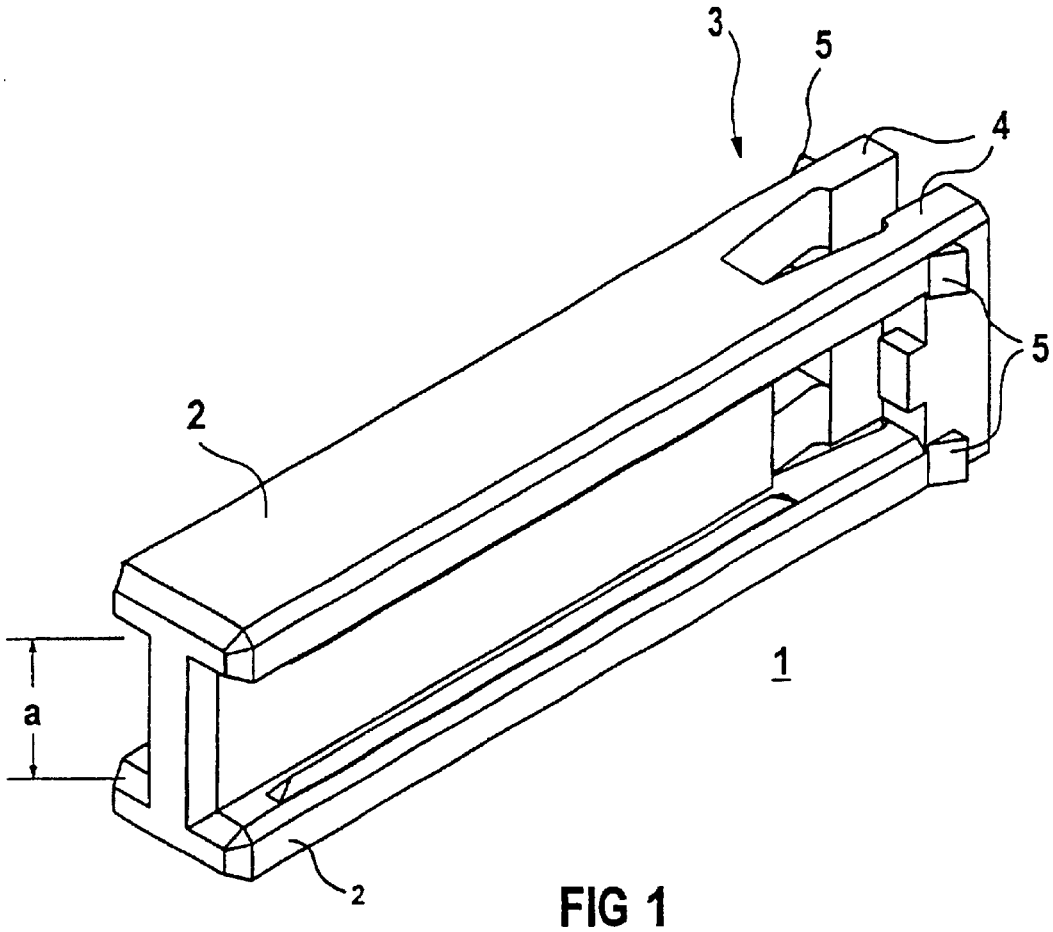
FIG. 1 is a perspective view of a connecting element, in accordance with an example embodiment of the present invention.

FIG. 1 shows a perspective view of a connecting element 1 for joining individual contactors to form a contactor combination. Connecting element 1 has T-shaped engagement sections 2. In head area 3, connecting element 1 is designed with two resilient legs 4 with catches 5 molded on their outside surfaces. Distance a of engagement sections 2 is adapted to the installation clearance of the individual contactors.

Figure 2:
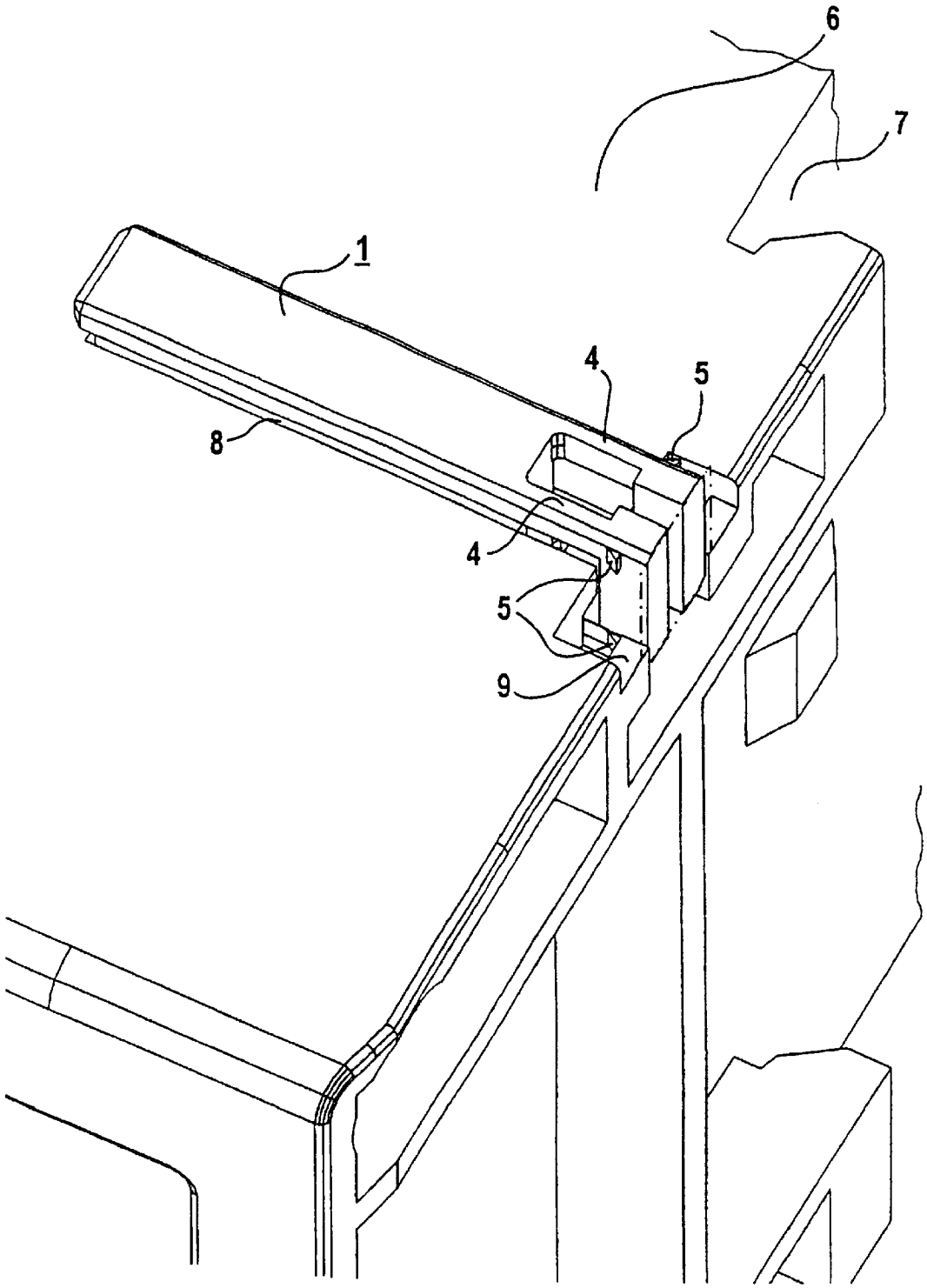
FIG. 2 shows the connecting element according shows FIG. 1 after engaging in an individual contactor.

FIG. 2 shows a connecting element 1 in the engaged state in an individual contactor 6, only a portion of which is shown here. The coupling site here is outside top-hat rail mount 7 of the individual contactor, which has an engagement groove 8 shaped to fit in coupling connecting element 1, consequently also T-shaped. Connecting element 1 is engaged here by its catches 4 on a housing contour 9 of individual contactor 6 after insertion into engagement groove 8. The design with resilient legs 4 is important for both insertion and for dismantling. To dismantle the contactor combination, connecting element 1 is gripped with pincers in head area 3 and pulled out of engagement grooves 8 of the magnet chambers of individual contactors 6. In this operation, the engagement of connecting element 1 is automatically released.

Depending on the installation clearance of the individual contactor, connecting element 1 is designed with a suitably adapted distance a between its engagement sections 2.

Although the present invention is explained with reference to the embodiment illustrated in the accompanying drawing, it should be noted that the invention is not meant to be limited only to the embodiment shown here, but instead all possible changes, modifications and equivalent arrangements are to be included to the extent they are covered by the content of the patent claims.

What is claimed is:

1. A contactor arrangement, comprising:

two individual contactors having engagement grooves;

a connecting element, the contactors being detachably joined by the connecting element, the connecting element including engagement sections inserted into the engagement grooves of the contactors, each of the contactors being paired with a respective one of the engagement sections, the engagement sections being spaced at a distance from one another, the distance being adapted to an installation clearance of the contactors, the connecting element having a head area with two resilient legs, each of the legs being provided with a catch, each catch being engaged on one of the contactors, the engagement of each catch being released by gripping the legs, the legs being accessible from outside of the contactor arrangement when the legs are engaged on the contactors.

* * * * *